US010019971B2

(12) United States Patent
Mathew et al.

(10) Patent No.: US 10,019,971 B2
(45) **Date of Patent: *Jul. 10, 2018**

(54) SWITCHING VIDEO STREAMS FOR A DISPLAY WITHOUT A VISIBLE INTERRUPTION

(71) Applicant: Apple Inc., Cupertino, CA (US)

(72) Inventors: Binu Mathew, Los Gatos, CA (US); William C. Athas, San Jose, CA (US); Nils E. Mattisson, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 343 days.

This patent is subject to a terminal disclaimer.

(21) Appl. No.: 14/276,190

(22) Filed: May 13, 2014

(65) Prior Publication Data

US 2014/0247270 A1 Sep. 4, 2014

Related U.S. Application Data

(63) Continuation of application No. 12/795,468, filed on Jun. 7, 2010, now Pat. No. 8,730,251.

(51) Int. Cl.
*G09G 5/399* (2006.01)
*G09G 5/395* (2006.01)

(52) U.S. Cl.
CPC ..... *G09G 5/399* (2013.01); *G09G 5/395* (2013.01)

(58) Field of Classification Search
CPC .... G09G 2340/125; G09G 5/36; G09G 5/363; G09G 5/39; G09G 5/393; G09G 5/395;
(Continued)

(56) References Cited

U.S. PATENT DOCUMENTS 5,259,004 A 11/1993 Nakayama
5,621,431 A 4/1997 Harper et al.
(Continued)

FOREIGN PATENT DOCUMENTS

EP 0497377 A2 8/1992
EP 1061434 12/2000
(Continued)

OTHER PUBLICATIONS

Gardner, Floyd M., "Charge-Pump Phase-lock Loop", IEEE Transactions on Communications, vol., Com-28, No. 11, Nov. 1980, pp. 1849-1858.

*Primary Examiner* — Sae Won Yoon
(74) *Attorney, Agent, or Firm* — David K. Cole

(57) ABSTRACT

The disclosed embodiments provide a system that facilitates driving a display in a computer system. During operation, the system receives an input video stream from a graphics source, wherein the input video stream comprises a sequence of video frames. Next, the system directs the input video stream through a set of two or more memory buffers including a front buffer and a back buffer to produce an output video stream, which is used to drive the display. While directing the input video stream through the set of memory buffers, the system writes a video frame from the input video stream into the back buffer, and concurrently drives the output video stream from a preceding video frame in the front buffer. When the writing of the video frame completes, the system switches buffers so that the back buffer becomes the front buffer, which drives the output video stream, and the front buffer becomes either a spare buffer or the back buffer, which receives a subsequent frame from the input video stream.

8 Claims, 4 Drawing Sheets

(58) Field of Classification Search
CPC . G09G 5/399; G06T 1/60; H04N 5/04; H04N 5/06; H04N 5/0736; H04N 5/268; H04N 5/76; H04N 5/775; H04N 9/641
USPC ..... 345/545, 547; 348/500, 705
See application file for complete search history.

(56) References Cited

U.S. PATENT DOCUMENTS 5,727,192 A 3/1998 Baldwin
6,262,776 B1 * 7/2001 Griffits ..... H04N 5/04 348/512
RE37,508 E 1/2002 Taylor et al.
6,385,267 B1 5/2002 Bowen et al.
6,424,320 B1 7/2002 Callway
6,487,719 B1 11/2002 Itoh et al.
6,535,208 B1 3/2003 Saltchev et al.
6,624,816 B1 9/2003 Jones, Jr.
6,778,187 B1 8/2004 Yi
6,807,232 B2 10/2004 Nicholson et al.
6,850,240 B1 2/2005 Jones, Jr.
7,003,114 B1 * 2/2006 Mauro ..... H04L 9/12 380/255
7,068,278 B1 6/2006 Williams et al.
7,262,776 B1 8/2007 Wilt et al.
7,522,167 B1 4/2009 Diard et al.
7,524,010 B2 4/2009 Yamada
7,576,745 B1 8/2009 de Waal et al.
7,668,189 B1 * 2/2010 Grimes ..... H04L 29/06 370/419
7,821,489 B2 * 10/2010 Oshima ..... G06F 1/3203 345/102
8,199,158 B2 * 6/2012 Samson ..... G06F 1/3203 345/501
8,233,000 B1 * 7/2012 Diard ..... G06F 1/3206 345/502
8,266,333 B1 * 9/2012 Wade ..... H04N 19/436 710/14
2001/0019362 A1 * 9/2001 Nakamura ..... H04N 1/212 348/222.1
2001/0022587 A1 9/2001 Ono
2002/0033812 A1 3/2002 Van Vugt
2002/0126122 A1 9/2002 Yet et al.
2003/0184662 A1 * 10/2003 Porter ..... H04N 1/2112 348/231.1
2003/0227460 A1 12/2003 Schinnerer
2004/0075622 A1 4/2004 Shiuan et al.
2004/0174367 A1 9/2004 Liao
2004/0207618 A1 10/2004 Williams
2004/0246257 A1 12/2004 MacInnis et al.
2005/0012749 A1 1/2005 Gonzalez et al.
2005/0033806 A1 * 2/2005 Harvey ..... H04L 12/1813 709/204
2005/0035928 A1 2/2005 De Greef
2005/0083339 A1 4/2005 Wilt et al.
2005/0093854 A1 5/2005 Kennedy et al.
2005/0179702 A1 * 8/2005 Tomlinson ..... G09G 5/363 345/629
2005/0237327 A1 10/2005 Rubinstein et al.
2005/0244131 A1 11/2005 Uehara
2005/0285863 A1 12/2005 Diamond
2005/0289361 A1 12/2005 Sutardja
2006/0007203 A1 1/2006 Chen et al.
2006/0012540 A1 1/2006 Logie
2006/0132491 A1 6/2006 Riach et al.
2006/0197768 A1 9/2006 Van Hook et al.
2006/0203730 A1 * 9/2006 Zur ..... H04L 47/10 370/235
2006/0284884 A1 12/2006 Cahill, III
2007/0139445 A1 6/2007 Khan et al.
2007/0283175 A1 12/2007 Marinkovic et al.
2008/0030509 A1 2/2008 Conroy et al.
2008/0055318 A1 3/2008 Glen
2008/0184042 A1 * 7/2008 Parks ..... G06F 1/3203 713/300
2008/0186319 A1 8/2008 Boner
2009/0027403 A1 * 1/2009 Jung ..... G06F 9/505 345/505
2009/0079746 A1 3/2009 Howard et al.
2009/0109334 A1 * 4/2009 Murakami ..... H04N 5/268 348/500
2009/0204790 A1 * 8/2009 Khan ..... G06T 1/00 712/200
2009/0295811 A1 * 12/2009 Falchetto ..... G06F 15/16 345/502
2010/0007673 A1 1/2010 Swic
2010/0053177 A1 3/2010 Diard et al.
2010/0123725 A1 * 5/2010 Azar ..... G06F 3/14 345/501
2010/0253690 A1 * 10/2010 Rose ..... G06F 1/3218 345/502
2010/0295999 A1 11/2010 Li
2011/0060894 A1 * 3/2011 Graef ..... G06F 1/3287 712/229
2011/0157202 A1 6/2011 Kwa et al.

FOREIGN PATENT DOCUMENTS

JP 5-113785 5/1993
JP 200612126 1/2006
WO 02086745 10/2002
WO 2006055608 5/2006
WO 2007140404 12/2007

* cited by examiner

SWITCHING VIDEO STREAMS FOR A DISPLAY WITHOUT A VISIBLE INTERRUPTION

This application is a continuation of patent application Ser. No. 12/795,468, filed Jun. 7, 2010, which is hereby incorporated by referenced herein in its entirety. This application claims the benefit of and claims priority to patent application Ser. No. 12/795,468, filed Jun. 7, 2010.

BACKGROUND

The disclosed embodiments relate to techniques for switching between graphics sources to drive a display in a computer system. More specifically, the disclosed embodiments relate to a buffering technique that facilitates switching between graphics sources to drive a display without a visible interruption.

To operate without interruption, computer displays require a constant video stream from a graphics source. However, a modern computer system often drives a display from different graphics sources. For example, a computer system may include multiple graphics processing units (GPUs), which provide differing levels of graphics-processing performance and consume different amounts of power. This enables the computer system to switch a display between different GPUs in a manner that balances changing graphics-processing requirements and power consumption. Unfortunately, video streams from the different graphics sources are not necessarily synchronized with each other, and the process of starting up a graphics source can take some time. As a consequence, the process of switching between different graphics sources can cause user-visible display glitches.

Hence, what is needed is a technique that facilitates driving a display using different graphics sources without the above-described problems.

SUMMARY

The disclosed embodiments provide a system that facilitates driving a display in a computer system. During operation, the system receives an input video stream from a graphics source, wherein the input video stream comprises a sequence of video frames. Next, the system directs the input video stream through a set of two or more memory buffers including a front buffer and a back buffer to produce an output video stream, which is used to drive the display. While directing the input video stream through the set of memory buffers, the system writes a video frame from the input video stream into the back buffer, and concurrently drives the output video stream from a preceding video frame in the front buffer. When the writing of the video frame completes, the system switches buffers so that the back buffer becomes the front buffer, which drives the output video stream, and the front buffer becomes either a spare buffer or the back buffer, which receives a subsequent frame from the input video stream.

In some embodiments, if the input video stream goes offline, the system temporarily halts the switching of the buffers, and continues to drive the output video stream from the front buffer until the input video stream comes back online.

In some embodiments, the system receives a second input video stream from a second graphics source, and performs a switching operation to direct the second input video stream through the set of memory buffers instead of the input video stream. While the switching operation is in progress, the system temporarily halts the switching of the buffers and continues to drive the output video stream from the front buffer until the switching operation completes.

In some embodiments, after the switching operation completes, if the switching operation introduced a buffering time lag between the input video stream and the output video stream, the system reduces the time lag during successive video frames until the time lag is eliminated.

In some embodiments, while the input video stream is being directed through the set of memory buffers, the system allows a processor to perform direct rendering operations into the back buffer.

In some embodiments, the system switches the input video stream to a live path, which bypasses the set of memory buffers, to produce the output video stream. After the input video stream is switched to the live path, the system can conserve power by removing power from the set of memory buffers.

In some embodiments, receiving the input video stream involves selecting the input video stream from one or more graphics sources.

In some embodiments, the one or more graphics sources include: a graphics processing unit (GPU); a plane within a GPU; or a graphics stream.

DETAILED DESCRIPTION

Figure 1:
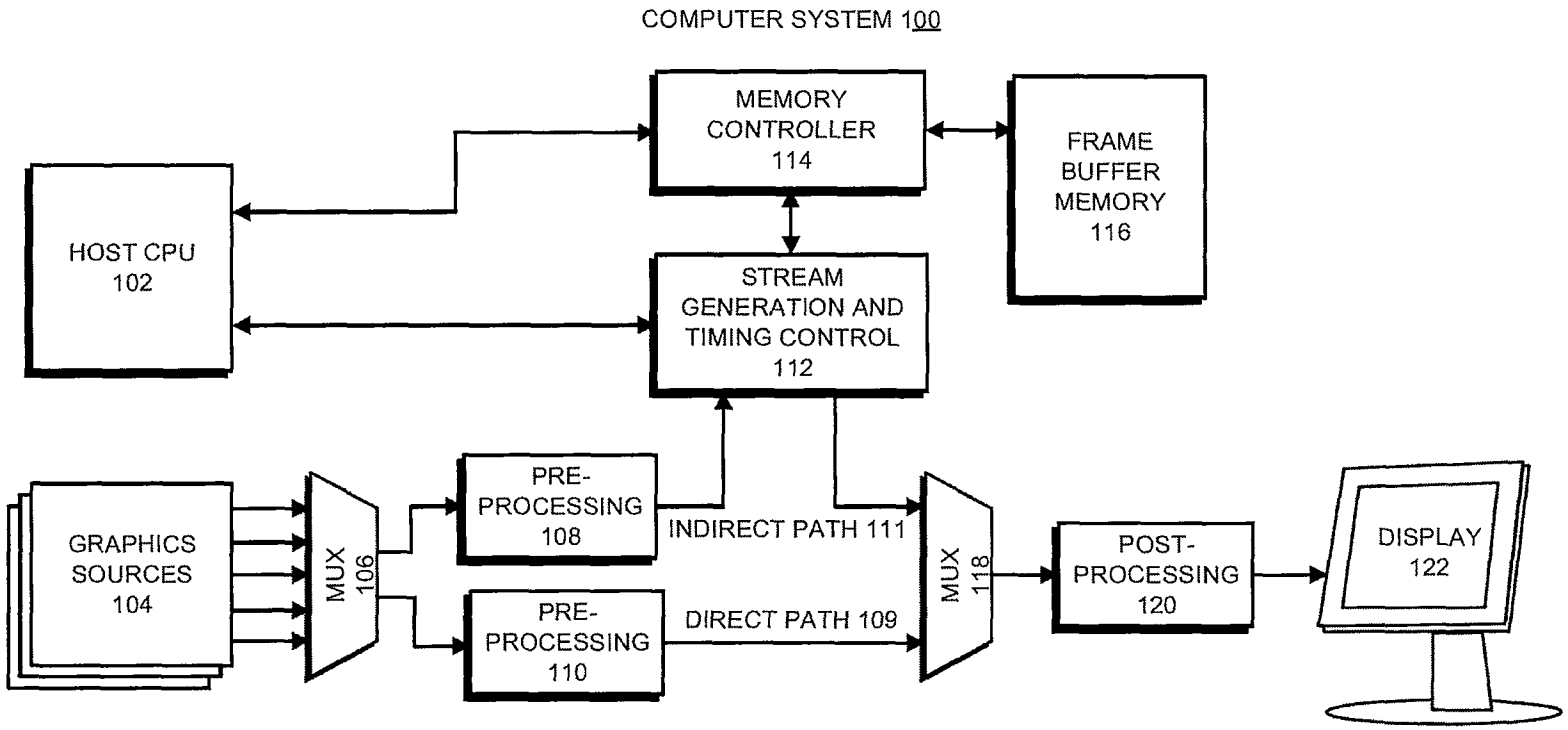
FIG. 1 illustrates a computer system which can switch between different graphics sources to drive a display in accordance with one embodiment.

The disclosed embodiments provide a system which is interposed between the graphics sources and the display and has the ability to either pass through a frame or output an internally generated frame that may be based on previously captured frames. One embodiment of the system provides a frame buffer and a multiplexer integrated with digital logic that controls the video stream. This system either directly passes the video stream through to the display or stores a frame from the video stream to the frame buffer. The stored frame can then be retransmitted to the display indefinitely (and independently of the graphics source), thereby enabling the system to power down the graphics source while still refreshing the display using the stored frame.

This system facilitates receiving several video streams, which are not necessarily synchronized, from primary graphics sources (such as GPUs), and then capturing and saving complete or incremental frames to a frame buffer in an internal memory. Note that this capturing process may be turned on or off automatically or semi-automatically under host software control.

The system also facilitates generating an output video stream, which corresponds to one of the input streams or an internally generated stream, and optionally adding a time shift relative to the input streams. The disclosed embodiments also facilitate sustaining the output display using an internally generated stream, thereby permitting one or more of the video sources to be taken offline. Note that by controlling the relative timing of the input, output and internal streams, the system facilitates switching the output between any of the input streams or the internal stream with no user-visible display glitches.

The system also facilitates complete or incremental modification of the internal frame buffer from a host or auxiliary processor, thereby allowing screen updates, graphical user interface (GUI) events and cursor movements to occur even when the primary graphics sources are offline. In this way, the processor can control an internally generated cursor in the internal frame buffer (even when the frame buffers are not switching), which gives the user an indication that the system is still responsive.

The system also provides support for optional transformations, such as quantization, dithering and backlight adaptation, which may be applied to the input and/or output streams. The input and output streams may also have different signaling protocols, such as LVDS or Display Port, and the system may convert between stream formats.

The system provides a number of advantages. For example, graphics sources such as GPUs can cause significant power dissipation, even while displaying a still image, or an image with relatively small changes between successive frames. The system also facilitates turning off a graphics source and sustaining the display using an internally generated image stream based on previously captured frames, thereby reducing system power dissipation significantly.

The system can also support multiple graphics sources, such as a high-performance high-power GPU and a low-performance energy-efficient GPU. These sources are often not synchronized with each other, and the process of switching between the sources can cause user-visible display glitches. By using the internal memory to store frame data and adapting the synchronization signals in conjunction with time shifting the video stream, the system can facilitate switching between such graphics sources without causing display glitches.

Moreover, the delay from turning on power for a GPU to the point where the GPU provides valid frames may range from a few hundred milliseconds to several seconds. Hence, without the above-described system, it is impractical to aggressively turn off GPUs to save power, because during the GPU initialization process the user will notice that the display is unresponsive to user actions such as cursor movement.

The system also provides the ability to apply modifications, such as cursor movement under host software control, to previously captured frames when the system internally generates a video stream. In addition, the host software may directly modify captured frames in the internal frame buffer, thereby permitting partial updates to be made to the last frame received before all graphics sources were taken offline. This may, for example, be used to render GUI events, such as the display of a clock in a GUI. In this case, the display appears to be responsive to the user, even while the GPU is offline or in the process of being brought online.

For usage scenarios such as browsing, word processing and full screen movie playback, much of the computational effort for GUI updates happens on the CPU, and the GPU workload is quite low. For example, while browsing, all network activity, parsing of HTML and images, and font rendering happens on the CPU, the GPU is finally invoked to update the rendered window area to the frame buffer. In this scenario, the system can be used to take all GPUs offline when the GUI workload is low, thereby allowing the software on the CPU to directly render images into the internal frame buffer, which leads to significant power savings and increased battery life. If the GUI workload increases beyond some threshold, the software can bring a GPU online and can switch over to a video stream from that GPU without display glitches. Hence, the described system facilitates switching between several video streams (or no video stream) without a visible interruption. Also, because the CPU provides some level of GUI rendering and cursor updating during the transition period, the system will appear to be responsive to the user.

Note that capturing frames for later redisplay is itself a cause of power dissipation. To alleviate this problem, the system can use techniques that automatically reduce the bandwidth and power required to capture frames by comparing the differences between successive frames.

The above-described system is described in more detail below, but first we describe the associated computer system hardware.

Computer System

FIG. 1 illustrates a computer system 100 which can switch between graphics sources 104 to drive a display 122. Note that the graphics sources 104 can include different GPUs or different planes within a GPU. During system operation, multiplexer (MUX) 106 selects a graphics source from graphics sources 104 to drive display 122. The output of MUX 106 is directed to display 122 through either a direct path 109 or an indirect path 111.

A video stream on direct path 109 feeds through pre-processing circuitry 110 and then into MUX 118, which selects a stream from either the direct path 109 or the indirect path 111 to drive display 122. The selected stream feeds through post-processing circuitry 120 before driving display 122. Note that direct path 109 is useful for applications which are sensitive to the buffering delay through indirect path 111. For example, video games, which require users to quickly react to changes in display output, will not function well with a typical 16 ms delay introduced by frame buffering.

A video stream through indirect path 111 similarly feeds through pre-processing circuitry 108 before feeding through stream-generation-and-timing-control circuitry 112 and memory controller 114, and then into a set of buffers in frame buffer memory 116. Note that stream-generation-and-timing-control circuitry 112 performs various operations, such as generating horizontal and vertical timing signals, fetching data from buffer memory, determining when a next frame is due and determining when to swap between frames. Also note that memory controller 114 is a dedicated frame-buffer memory controller, which is separate from a general system memory controller. Moreover, the set of buffers in frame buffer memory 116 includes a front buffer, which drives the display, and a back buffer, which receives a next frame from the video stream. The set of buffers can also include additional buffers to accommodate additional frames (between the frame stored in the front buffer and the frame stored in the back buffer), which can be used to mask a time lag which is greater than one frame. After the stream is buffered in frame buffer memory 116, the stream feeds back through memory controller 114 and stream-generation-and-timing-control circuitry 112 before feeding into MUX 118.

Note that pre-processing circuitry 108 and 110 and post-processing circuitry 120 can perform various graphics-processing operations, such as dynamic backlight adaptation, quantization, dithering, gamma correction, format conversion and compression. Post-processing circuitry 120 can also overlay a cursor on a display stream under control of host CPU 102.

During system operation, host CPU 102 interacts with memory controller 114 and stream-generation-and-timing-control circuitry 112. For example, host CPU 102 can incrementally or completely modify a video frame by performing direct-rendering operations into a buffer in frame buffer memory 116. This allows screen updates, GUI events and cursor movements to occur, even when the primary graphics sources are offline.

Buffering Process

Figure 2:
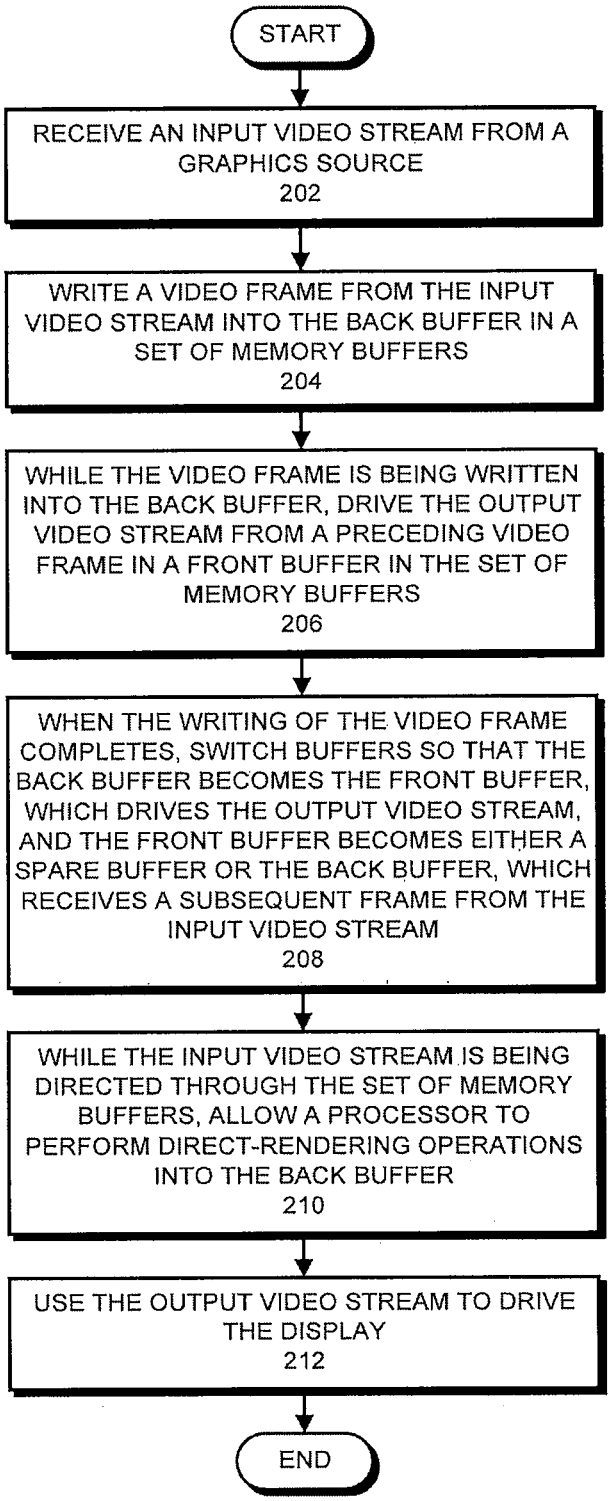
FIG. 2 presents a flow chart illustrating the operations involved in directing a video stream through a set of memory buffers in accordance with one embodiment.

FIG. 2 presents a flow chart illustrating operations involved in directing a video stream through a set of memory buffers along direct path 109 in accordance with one embodiment. During operation, the system receives an input video stream from a graphics source, wherein the input video stream comprises a sequence of video frames (step 202). Next, the system writes a video frame from the input video stream into the back buffer in the set of memory buffers (step 204). While the video frame is being written, the system drives the output video stream from a preceding video frame in the front buffer (step 206). When the writing of the video frame completes, the system switches buffers so that the back buffer becomes the front buffer, which drives the output video stream, and the front buffer becomes either a spare buffer or the back buffer, which receives a subsequent frame from the input video stream (step 208).

While the input video stream is being directed through the set of memory buffers, the system allows a processor to perform direct-rendering operations into the back buffer (step 210). Finally, the system uses the output video stream to drive the display (step 212).

Note that, because the processor generally wakes up more quickly from a sleep state than the GPUs, the direct-rendering operations can be used to improve the user experience during the wake-up period by allowing the user to move the cursor, or by updating the clock while the GPUs are waking up. Note that the system can alternatively leave the GPU in a sleep state while the processor performs updating operations until the graphics-processing load picks up. If there are multiple GPUs, the system can first activate a low-power GPU, and then a high-power GPU if the graphics-processing load increases.

Also note that it is possible to incrementally update the frame in the buffer memory. This can save on power involved in writing to the buffer memory. To implement incremental updates, each video frame can be divided into tiles, wherein each tile in a memory buffer can be either a "back tile" or a "front tile," with a bit indicating which tile is front or back. The system can also store a hash of the tile along with this bit. Whenever the system writes new data, the system computes the hash of the tile. If the hash is the same as the previous hash, the system does not update the tile or change the front/back status. Because false positives may occur, the system periodically overwrites each tile with new data.

Switching Video Streams

Figure 3:
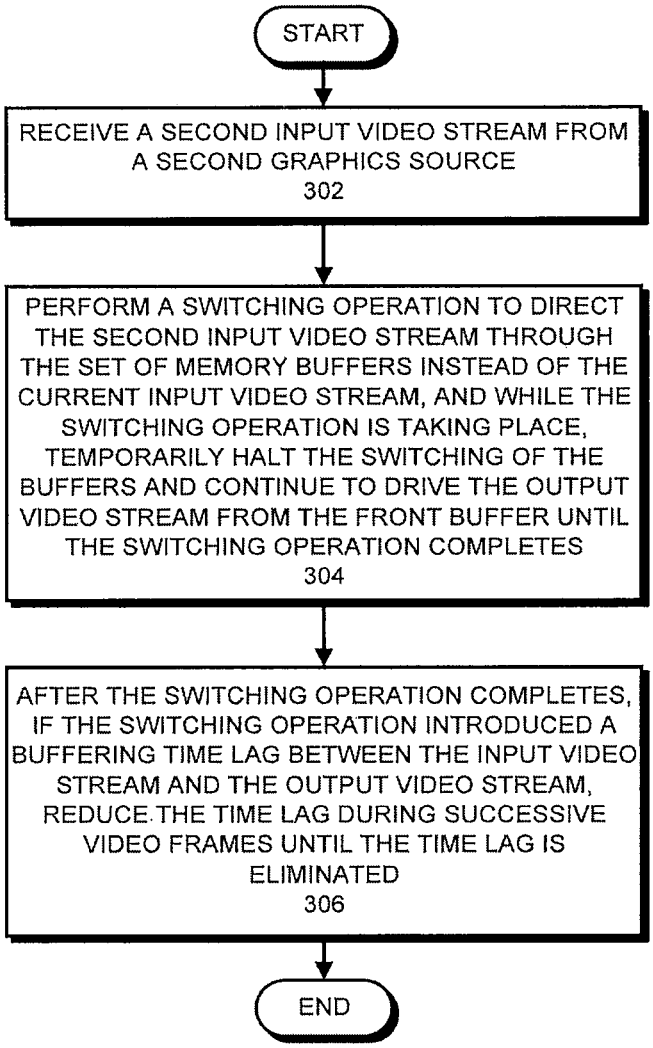
FIG. 3 presents a flow chart illustrating the operations involved in switching between video streams in accordance with one embodiment.

FIG. 3 presents a flow chart illustrating the operations involved in switching between video streams in accordance with one embodiment. During operation, the system receives a second input video stream from a second graphics source (step 302). Next, the system performs a switching operation to direct the second input video stream through the set of memory buffers instead of the current input video stream. While the switching operation is taking place, the system temporarily halts the switching of the buffers and continues to drive the output video stream from the front buffer until the switching operation completes. (step 304).

Note that this is an improvement over existing techniques for switching between unsynchronized graphics sources. These existing techniques ensure synchronization by waiting to switch streams until the precessing of frames from the different graphics sources causes blanking intervals from the unsynchronized graphics sources to align. (For example, see related U.S. patent application Ser. No. 11/499,167, filed 4 Aug. 2006, entitled "Method and Apparatus for Switching Between Graphics Sources," by inventors David G. Conroy, Michael F. Culbert, William C. Athas and Brian D. Howard.) After this alignment, the switching can take place without causing a user-visible display glitch. Because the precessing can be slow, these existing techniques may have to wait as long as a few seconds before switching.

Finally, after the switching operation completes, if the switching operation introduced a buffering time lag between the input video stream and the output video stream, the system can reduce the time lag during successive video frames until the time lag is eliminated (step 306). For example, the time lag can be reduced gradually between successive frames, so that the time lag is eliminated after about 10 frames.

Video Stream Going Offline

Figure 4:
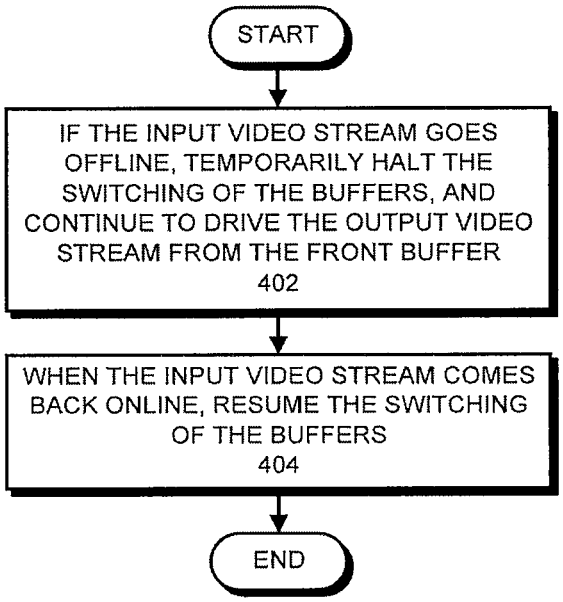
FIG. 4 presents a flow chart illustrating the operations that take place when a video stream goes offline in accordance with one embodiment.

FIG. 4 presents a flow chart illustrating the operations that take place when a video stream goes offline in accordance with one embodiment. During system operation, if the input video stream goes offline, the system temporarily halts the switching of the buffers, and continues to drive the output video stream from the front buffer (step 402).

Next, when the input video stream comes back online, the system resumes switching the buffers (step 404). This involves writing a next video frame from the input video stream to the back buffer, and when this frame is written, performing a switching operation so that the back buffer becomes the front buffer. Note that, when a video source, such as a GPU, is turned off to save power and is turned on again at a later time, there will typically be a delay of some hundreds of milliseconds or even seconds before the GPU is live again. During this delay period, switching will remain disabled, and the display will be driven by the front buffer.

Switching Between Indirect Path and Live Path

Figure 5:
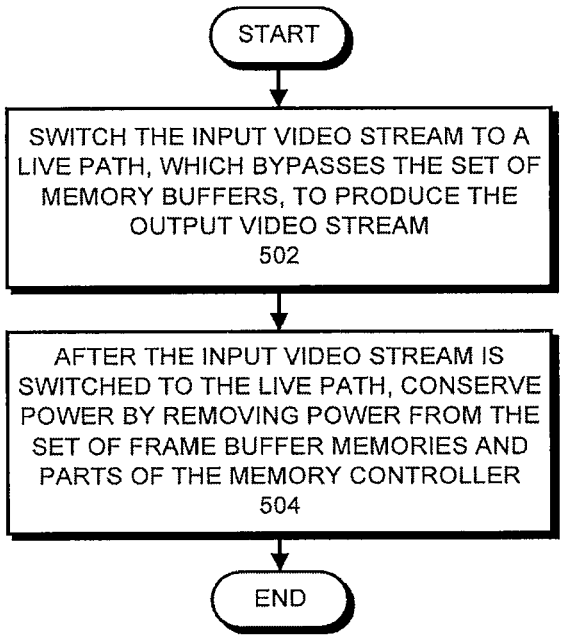
FIG. 5 presents a flow chart illustrating the operations involved in switching a video stream to a live path in accordance with one embodiment.

FIG. 5 presents a flow chart illustrating the operations involved in switching a video stream to a live path in accordance with one embodiment. During operation, the system can switch the input video stream to a live path, which bypasses the set of memory buffers, to produce the output video stream (step 502). This can involve precessing the timing between the direct path and the indirect path until the time difference is so small that all of the data associated with the time difference will fit into small internal buffers in the stream-generation unit without having to be sent to the large frame buffer memory. At this point the video stream can be switched to the live path without causing a display glitch.

Next, after the input video stream is switched to the live path, the system can conserve power by removing power from the set of frame buffer memories and parts of the memory controller (step 504).

Note that when the video stream is being fed through the direct path, it is possible to concurrently send the stream (or differences between successive frames in the stream)

through the indirect path to maintain a full frame in the frame buffer memory. In this case, if the graphics source goes offline, the display can be driven from the frame buffer memory. This also facilitates rapidly switching to the indirect path from the direct path.

The foregoing descriptions of embodiments have been presented for purposes of illustration and description only. They are not intended to be exhaustive or to limit the present description to the forms disclosed. Accordingly, many modifications and variations will be apparent to practitioners skilled in the art. Additionally, the above disclosure is not intended to limit the present description. The scope of the present description is defined by the appended claims.

Moreover, the preceding description is presented to enable any person skilled in the art to make and use the disclosed embodiments, and is provided in the context of a particular application and its requirements. Various modifications to the disclosed embodiments will be readily apparent to those skilled in the art, and the general principles defined herein may be applied to other embodiments and applications without departing from the spirit and scope of the disclosed embodiments. Thus, the disclosed embodiments are not limited to the embodiments shown, but are to be accorded the widest scope consistent with the principles and features disclosed herein.

The methods and processes described in the detailed description section can be embodied as electrical circuitry, or alternatively as code and/or data, which can be stored in a computer-readable storage medium as described above. When a computer system reads and executes the code and/or data stored on the computer-readable storage medium, the computer system performs the methods and processes embodied as data structures and code and stored within the computer-readable storage medium. Furthermore, the methods and processes described below can be incorporated into hardware modules. For example, the hardware modules can include, but are not limited to, application-specific integrated circuit (ASIC) chips, field-programmable gate arrays (FPGAs), and other programmable-logic devices now known or later developed. When the hardware modules are activated, the hardware modules perform the methods and processes included within the hardware modules.

What is claimed is:

1. A method for driving a display using a plurality of graphics processing units, comprising:

receiving a first input video stream from a first graphics processing unit of the plurality of graphics processing units;

directing the first input video stream over an indirect path through a set of memory buffers to produce an output video stream;

while directing the first input video stream over the indirect path, simultaneously directing the first input video stream in parallel over a direct path which bypasses the set of memory buffers;

using either the produced output video stream or the bypassed first input video stream to drive the display;

wherein the set of memory buffers includes a front buffer and a back buffer and wherein directing the first input video stream over the indirect path through the set of memory buffers to produce the output video stream comprises:

writing a video stream from the first input video stream into the back buffer, while writing the video stream into the back buffer, producing the output video stream from a preceding video frame in the front buffer, and after writing the video stream into the back buffer and after producing the output video stream from the preceding video frame in the front buffer, switching the front and back buffers so that the back buffer becomes the front buffer in order for the video stream written in the back buffer to be used for driving the display, and the front buffer becomes the back buffer in order to write a next video stream;

receiving a second input video stream from a second graphics processing unit of the plurality of graphics processing units;

performing a switching operation to direct the second input video stream through the set of memory buffers over the indirect path instead of the first input video stream, wherein performing the switching operation comprises:

halting the switching of the buffers during the switching operation, continuing to produce the output video stream from the front buffer to drive the display until the switching operation completes, and resuming the switching of the buffers by writing the second input video stream in the back buffer after the switching operation completes;

wherein the method further comprises:

taking all of the plurality of graphics processing units offline; and while taking all of the plurality of graphics processing units offline, modifying frames in the set of memory buffers using a central processing unit (CPU).

2. The method of claim 1, further comprising:

when at least the first graphics processing unit of the plurality of graphics processing units comes online, directing the first input video stream over only one of the indirect path or the direct path instead of directing the first input video stream over the indirect path and the direct path in parallel, wherein when the first input stream is directed over only the direct path, power is conserved by removing the power from the set of memory buffers.

3. The method defined in claim 1, further comprising:

in response to a graphical user interface (GUI) workload increasing beyond a threshold, bringing one of the first graphics processing unit and the second graphics processing unit online.

4. A computer system, comprising:

a display;

a central processing unit (CPU);

a memory;

a first graphics processing unit that provides a first input video stream;

a set of memory buffers that includes a front buffer and a back buffer, wherein the computer system is configured to direct the first input video stream received from the first graphics processing unit over an indirect path through the set of memory buffers to produce an output video stream, wherein the computer system is configured to simultaneously direct the first input video stream in parallel over a direct path which bypasses the set of memory buffers while directing the first input video stream over the indirect path, wherein the computer system is configured to drive the display using either the produced output video stream or the bypassed first input video stream, and when the computer system is directing the first input video stream over the indirect path through the set of memory buffers to produce the output video stream, the computer system is configured to write a video frame from the first input video stream in the back buffer, produce the output video stream from a preceding video frame in the front buffer while writing the video frame in the back buffer, and switch the front and back buffers after the video frame is written into the back buffer and after producing the output video stream from the preceding video frame in the front buffer so that the back buffer becomes the front buffer in order for the video stream in the back buffer to be used for driving the display and the front buffer becomes the back buffer in order to write a next video stream; and a second graphics processing unit that provides a second input video stream, wherein the computer system is configured to perform a switching operation to direct the second input video stream received from the second graphics processing unit over the indirect path through the set of memory buffers instead of the first input video stream, by halting the switching of the buffers during the switching operation, continuing to produce the output video stream from the front buffer to drive the display until the switching operation is complete, and resuming the switching of the buffers by writing the second input video stream in the back buffer after the switching operation completes;

wherein the computer system is further configured to:

use the CPU to perform direct-rendering operations into the set of memory buffers while the first input video stream is being directed through the set of memory buffers.

5. A method for driving a display, comprising:

with a multiplexer, receiving a first input video stream from a first graphics processing unit;

directing the first input video stream over an indirect path through a set of memory buffers to produce an output video stream;

while directing the first input video stream over the indirect path, simultaneously directing the first input video stream in parallel over a direct path which bypasses the set of memory buffers;

using either the produced output video stream or the bypassed first input video stream to drive the display;

wherein the set of memory buffers includes a front buffer and a back buffer and wherein directing the first input video stream over the indirect path through the set of memory buffers to produce the output video stream comprises:

writing a video stream from the first input video stream into the back buffer while writing the video stream into the back buffer, producing the output video stream from a preceding video frame in the front buffer, and after writing the video stream into the back buffer and after producing the output video stream from the preceding video frame in the front buffer, switching the front and back buffers so that the back buffer becomes the front buffer in order for the video stream written in the back buffer to be used for driving the display and the front buffer becomes the back buffer in order to write a next video stream;

incrementally updating the set of memory buffers by comparing a first hash of data in the set of memory buffers to a second hash of data in the set of memory buffers, wherein in response to determining that the first hash of data is the same as the second hash of data, the set of memory buffers retains the data associated with the first hash, and wherein in response to determining that the first hash of data is different from the second hash of data, the set of memory buffers overwrites the data associated with the first hash with the data associated with the second hash;

with the multiplexer, receiving a second input video stream from a second graphics processing unit;

performing a switching operation to direct the second input video stream over the indirect path through the set of memory buffers instead of the first input video stream, wherein performing the switching operation comprises:

halting the switching of the buffers during the switching operation, continuing to produce the output video stream from the front buffer to drive the display until the switching operation is complete, and resuming the switching of the buffers by writing the second input video stream in the back buffer after the switching operation completes; and wherein the method further comprises:

while one of the first input video stream and the second input video stream is being directed through the set of memory buffers, allowing a processor to perform direct-rendering operations into the set of memory buffers.

6. The method defined in claim 5, further comprising:

taking the first graphics processing unit and the second graphics processing unit offline; and while the first graphics processing unit and the second graphics processing unit are offline, modifying frames in the at least one memory buffer using the processor.

7. The method defined in claim 6, wherein the processor is a central processing unit (CPU).

8. The method defined in claim 7, further comprising:

in response to a graphical user interface (GUI) workload increasing beyond a threshold, bringing one of the first graphics processing unit and the second graphics processing unit online.

* * * * *